US007842657B2

(12) United States Patent
Tantawy et al.

(10) Patent No.: US 7,842,657 B2
(45) **Date of Patent: *Nov. 30, 2010**

(54) SPRAY-DRYING PROCESS

(75) Inventors: Hossam Hassan Tantawy, Northumberland (GB); Nigel Patrick Somerville Roberts, Newcastle upon Tyne (GB); Simon Howe, Tyne and Wear (GB); Stuart Andrew Caldwell, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/480,036

(22) Filed: Jun. 8, 2009

(65) Prior Publication Data

US 2009/0325850 A1 Dec. 31, 2009

(30) Foreign Application Priority Data

Jun. 25, 2008 (EP) ..... 08159033

(51) Int. Cl.
*C11D 11/02* (2006.01)

(52) U.S. Cl. ..... 510/443; 510/452

(58) Field of Classification Search ..... 510/443, 510/452

See application file for complete search history.

(56) References Cited

U.S. PATENT DOCUMENTS

| | | | | |
|---|---|---|---|---|
| 5,756,444 | A * | 5/1998 | Walters et al. | 510/299 |
| 5,773,400 | A * | 6/1998 | Baillely et al. | 510/315 |
| 6,528,474 | B1 * | 3/2003 | Artiga Gonzalez et al. | 510/453 |
| 7,078,373 | B2 * | 7/2006 | Burrows et al. | 510/351 |
| 2003/0203832 | A1 * | 10/2003 | Boucher et al. | 510/443 |
| 2005/0101503 | A1 * | 5/2005 | Caldwell et al. | 510/310 |
| 2006/0035802 | A1 * | 2/2006 | Brooker et al. | 510/445 |
| 2006/0035803 | A1 * | 2/2006 | Mort et al. | 510/445 |
| 2007/0037726 | A1 * | 2/2007 | Brooker et al. | 510/476 |

FOREIGN PATENT DOCUMENTS

| | | |
|---|---|---|
| EP | 273688 B1 | 9/1991 |
| WO | WO 96/03488 | 2/1996 |

OTHER PUBLICATIONS

PCT International Search Report, dated Sep. 16, 2009—7 pgs, (PCT/US2009/047298).

* cited by examiner

*Primary Examiner*—Lorna M Douyon

(57) ABSTRACT

The present invention relates to a process for preparing a spray-dried powder comprising (i) anionic detersive surfactant;

(ii) from 0 wt % to 10 wt % zeolite builder;

(iii) from 0 wt % to 10 wt % phosphate builder; and (iv) optionally from 0 wt % to 15 wt % silicate salt;

wherein the process comprises the steps of:

(a) forming an alkaline slurry in a mixer, the slurry having a viscosity of from X to Y $s^{-1}$ at a temperature of 70° C. and at a shear rate of 50 $s^{-1}$, wherein the alkaline slurry is shear thinning; and (b) transferring the alkaline slurry from the mixer through at least one pump to a spray pressure nozzle;

(c) contacting a viscosity increasing agent to the alkaline slurry after the mixer and before the spray pressure nozzle so as to increase the viscosity of the alkaline slurry to form a viscous alkaline slurry, step (c) being carried out at an average shear rate of from 10 $s^{-1}$ to 150 $s^{-1}$;

(d) spraying the viscous alkaline slurry through the spray pressure nozzle into a spray-drying tower;

(e) spray-drying the viscous alkaline slurry to form a spray-dried powder; and (f) optionally, contacting an alkalinity source with the alkaline slurry and/or the viscosity increasing agent, and/or the viscous alkaline slurry.

10 Claims, No Drawings

SPRAY-DRYING PROCESS

FIELD OF THE INVENTION

The present invention relates to a spray-drying process.

BACKGROUND OF THE INVENTION

Laundry detergent compositions are typically made by a process that involves the step of spray-drying an aqueous slurry comprising anionic detersive surfactant to form a spray-dried powder. Typically, this spray-drying step is the rate determining step in the production of the laundry detergent powder. This is especially true for low-built formulations that have increased drying loads. With increasing global laundry detergent powder volume demand, many detergent manufacturers' spray-drying towers are running at, or very near, maximum capacity. In order to increase the capacity of their existing spray-drying facilities, detergent manufacturers have to either invest in additional or upgraded spray-drying equipment.

The inventors have found that the carefully controlling the viscosity of a shear-thinning slurry, and increasing its viscosity under specifically controlled shear conditions at a later stage in the spray-drying process, allows for an increase in the capacity of the process without the need for investment in additional spray-drying equipment.

SUMMARY OF THE INVENTION

The present invention provides a process as described in herein.

DETAILED DESCRIPTION OF THE INVENTION

Spray-drying Process

The process for preparing a spray-dried powder comprises the steps of: (a) forming an alkaline slurry in a mixer, the slurry having a viscosity of from 0.5 to 50.0 Pas at a temperature of 70° C. and at a shear rate of 50 $s^{-1}$, wherein the alkaline slurry is shear thinning; and (b) transferring the alkaline slurry from the mixer through at least one pump to a spray pressure nozzle; (c) contacting a viscosity increasing agent to the alkaline slurry after the mixer and before the spray pressure nozzle so as to increase the viscosity of the alkaline slurry to form a viscous alkaline slurry, step (c) being carried out at an average shear rate of from 10 $s^{-1}$ to 150 $s^{-1}$; (d) spraying the viscous alkaline slurry through the spray pressure nozzle into a spray-drying tower; (e) spray-drying the viscous alkaline slurry to form a spray-dried powder; and (f) optionally, contacting an alkalinity source with the alkaline slurry and/or the acid anionic detersive surfactant precursor, and/or the viscous alkaline slurry.

Step (a)

In step (a), an alkaline slurry is formed in a mixer. The preferred mixer in step (a) is a crutcher mixer. The alkaline slurry in the mixer is preferably heated, typically in the range of 50° C. to 90° C. Saturated steam can be used to heat the slurry in the mixer. Preferably, all of the liquid components that make up the slurry are heated prior to addition to the mixer, and the slurry is preferably maintained at an elevated temperature in the mixer. These temperatures are preferably in the range of 50° C. to 90° C.

Typically, the residence time of the slurry in the mixer is in the range of from 20 seconds to 600 seconds.

The mixer in step (a) typically has a motor size such that its installed power is in the range of from 50 kW to 100 kW.

Step (b)

In step (b), the alkaline slurry is transferred from the mixer through at least one pump to a spray pressure nozzle. Typically, the alkaline slurry is first transferred to a low pressure line. The low pressure line typically has a pressure in the range of from $4.0\times10^5$ Pa to $1.2\times10^6$ Pa. Typically, the alkaline slurry is then pumped into a high pressure line. The high pressure line typically has a pressure in the range of from $4.0\times10^6$ Pa to $1.2\times10^7$ Pa. Typically, a high pressure pump is used to transfer the alkaline slurry from the low pressure line to the high pressure line. Preferably the high pressure pump is a piston pump.

Typically, the alkaline slurry passes through a second mixer during step (b). The second mixer is preferably a slurry disintegrator. The second mixer is typically operated at 1,000 rpm to 3,000 rpm. This second mixer reduces the particle size of the solid material in the slurry. The particle size of the solid material in the slurry at the end of step (b) is preferably less than 2.0 mm. This mitigates the risk of blocking the spray pressure nozzle.

Step (c)

In step (c), a viscosity increasing agent is contacted to the alkaline slurry after the mixer and before the spray pressure nozzle so as to increase the viscosity of the alkaline slurry to form a viscous alkaline slurry. Typically, step (c) is carried out at an average shear rate of from 10 $s^{-1}$ to 150 $s^{-1}$.

Preferably, the viscosity increasing agent is contacted to the alkaline slurry in a low pressure line. However, the viscosity increasing agent may be contacted to the alkaline slurry in a high pressure line. Typically, the temperature of the viscosity increasing agent is in the range of from 20° C. to 50° C. when it is contacted with the alkaline slurry. Typically, the ratio of the flow rate of the alkaline slurry to the flow rate of the viscosity increasing agent is controlled. This control is typically achieved by passing the viscosity increasing agent through a mass flow meter, and monitoring the mass flow rate of the alkaline slurry by a loss in weight system installed on a holding tank into which the alkaline slurry is typically transferred prior to it being pumped into the low pressure line. The ratio of the flow rate of the alkaline slurry to the flow rate of the viscosity increasing agent is typically in the range of from 2.5:1 to 25:1, preferably from 5:1, or from 8:1, and preferably to 20:1, or to 15:1.

Step (d)

In step (d), the viscous alkaline slurry is sprayed through the spray pressure nozzle into a spray-drying tower. Typically, the viscous alkaline slurry is sprayed at a pressure in the range of from $4.0\times10^6$ Pa to $1.2\times10^7$ Pa. Typically, the viscous alkaline slurry is sprayed at a mass flow rate in the range of from 1,000 $kghr^{-1}$ to 70,000 $kghr^{-1}$. Typically, a plurality of nozzles are used in the process, preferably the nozzles are positioned in a circumferential manner at different heights throughout the spray-drying tower. The nozzles are preferably positioned in a counter-current manner with respect to the air flow in the tower.

Step (e)

In step (e), the viscous alkaline slurry is spray-dried to form a spray-dried powder. Typically, the air in-let temperature is in the range of from 200° C. to 350° C. Typically, the air in-let flow rate is in the range of from 50,000 to 150,000 $kgm^{-3}$.

Optional Step (f)

In optional step (f), an alkalinity source is contacted with the alkaline slurry and/or the viscosity increasing agent, and/or the viscous alkaline slurry. Preferably, the alkalinity source is added to the alkaline slurry substantially simultaneously with the viscosity increasing agent.

Typically, the alkalinity is contacted to the alkaline slurry and/or the viscosity increasing agent, and/or the viscous alkaline slurry at a temperature above 10° C.; this is especially preferred when the alkalinity source comprises sodium hydroxide.

The alkalinity source can be contacted to the alkaline slurry and/or viscous alkaline slurry by injecting the alkalinity source into the low pressure line. Alternative, the alkalinity source, can be injected into the high pressure line.

Typically, the ratio of the flow rate of the alkaline slurry to the flow rate of the alkalinity source is controlled. This control is typically achieved by passing the alkalinity source through a mass flow meter. The control of the mass flow rate of the alkaline slurry is described in more detail above.

Alkaline Slurry

The alkaline slurry has a viscosity of from 0.5 to 50 Pas at a temperature of 70° C. and at a shear rate of 50 $s^{-1}$. The alkaline slurry is shear thinning. Preferably, the alkaline slurry has a viscosity of from 0.5, or from 1.0, or from 1.5, and to 40, or to 30, or to 20, or even to 10 Pas at a temperature of 70° C. and at a shear rate of 50 $s^{-1}$.

The alkaline slurry preferably comprises: (i) from 0 wt % to 15 wt % anionic detersive surfactant; and (ii) from 0 wt % to 35 wt % water.

The alkaline slurry typically comprises: (a) from 0 wt % to 15 wt % anionic detersive surfactant; and (b) from 0 wt % to 35 wt % water. The alkaline slurry preferably comprises from 0 wt %, or from above 0 wt %, and preferably to 30 wt %, or to 25 wt %, or to 20 wt %, or to 15 wt %, or even to 10 wt % water. The alkaline slurry may be substantially anhydrous. The alkaline slurry typically comprises one or more adjunct detergent ingredients. The alkaline slurry preferably comprises carbonate salt, preferably at least 5 wt %, or at least 10 wt % carbonate salt. Preferably, the alkaline slurry comprises from 0 wt % to 10 wt %, or from above 0 wt %, and preferably to 8 wt %, or to 6 wt %, or to wt %, or to 2 wt % anionic surfactant. The alkaline slurry may even be essentially free of anionic detersive surfactant. By essential free of, it is typically meant comprises no deliberately added.

The alkaline slurry may comprise polymeric material. A preferred polymeric material is a carboxylate polymer. The alkaline slurry may comprise at least 1 wt %, or even at least 2 wt % polymeric material.

Preferably, the weight ratio of solid inorganic material to solid organic material present in the slurry is in the range of from 10:1 to 10,000:1, preferably at least 35:1. The alkaline slurry may comprise less than 10 wt % solid organic material, or less than 5 wt % solid organic material. The alkaline slurry may even be essential free of solid organic material. For the purpose of the present invention, organic means any hydrocarbon component.

Viscous Alkaline Slurry

The viscous alkaline slurry has a higher viscosity than the alkaline slurry at a temperature of 70° C. and at a shear rate of 50 $s^{-1}$. Preferably, the viscous alkaline slurry has a viscosity in the range of from 10 Pas to 60 Pas at a temperature of 70° C. and at a shear rate of 50 $s^{-1}$. Preferably the viscous alkaline slurry has a viscosity that is at least two times higher, preferably at least four times higher, preferably at least six times higher, and even at least eight times higher than the viscosity of the alkaline slurry at a temperature of 70° C. and at a shear rate of 50 $s^{-1}$.

Spray-dried Powder

The spray-dried powder comprises: (i) anionic detersive surfactant; (ii) from 0 wt % to 10 wt % zeolite builder; (iii) from 0 wt % to 10 wt % phosphate builder; and (iv) optionally from 0 wt % to 15 wt % silicate salt. The spray-dried powder may comprise additional adjunct detergent ingredients.

The spray-dried powder typically has a particle size distribution such that the weight average particle size is in the range of from 300 micrometers to 600 micrometers, and preferably less than 10 wt % of the spray-dried powder has a particle size greater than 1,180 micrometers, and preferably less than 10 wt % of the spray-dried powder has a particle size of less than 150 micrometers.

Typically, the spray-dried powder has a bulk density in the range of from 100 g/l to 700 g/l. The spray-dried powder typically has a moisture content of less than 5 wt %, preferably less than 4 wt %, or even less than 3 wt %. Preferably, the spray-dried powder is white.

Acid Anionic Detersive Surfactant Precursor

The acid anionic detersive surfactant precursor preferably comprises $C_8$-$C_{24}$ alkyl benzene sulphonic acid.

Anionic Detersive Surfactant

The anionic detersive surfactant preferably comprises alkyl benzene sulphonate. Preferably the anionic detersive surfactant comprises at least 50%, preferably at least 55%, or at least 60%, or at least 65%, or at least 70%, or even at least 75%, by weight of the anionic detersive surfactant, of alkyl benzene sulphonate. Preferably the alkyl benzene sulphonate is a linear or branched, substituted or unsubstituted, $C_{8-18}$ alkyl benzene sulphonate. This is the optimal level of the $C_{8-18}$ alkyl benzene sulphonate to provide a good cleaning performance. The $C_{8-18}$ alkyl benzene sulphonate can be a modified alkylbenzene sulphonate (MLAS) as described in more detail in WO 99/05243, WO 99/05242, WO 99/05244, WO 99/05082, WO 99/05084, WO 99/05241, WO 99/07656, WO 00/23549, and WO 00/23548. Highly preferred $C_{8-18}$ alkyl benzene sulphonates are linear $C_{10-13}$ alkylbenzene sulphonates. Especially preferred are linear $C_{10-13}$ alkylbenzene sulphonates that are obtainable, preferably obtained, by sulphonating commercially available linear alkyl benzenes (LAB); suitable LAB include low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®.

The anionic detersive surfactant may preferably comprise other anionic detersive surfactants. A preferred adjunct anionic detersive surfactant is a non-alkoxylated anionic detersive surfactant. The non-alkoxylated anionic detersive surfactant can be an alkyl sulphate, an alkyl phosphate, an alkyl phosphonate, an alkyl carboxylate or any mixture thereof. The non-alkoxylated anionic surfactant can be selected from the group consisting of; $C_{10}$-$C_{20}$ primary, branched-chain, linear-chain and random-chain alkyl sulphates (AS), typically having the following formula:

$$CH_3(CH_2)_xCH_2—OSO_3^-M^+$$

wherein, M is hydrogen or a cation which provides charge neutrality, preferred cations are sodium and ammonium cations, wherein x is an integer of at least 7, preferably at least 9; $C_{10}$-$C_{18}$ secondary (2,3) alkyl sulphates, typically having the following formulae:

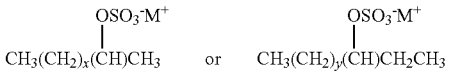

wherein, M is hydrogen or a cation which provides charge neutrality, preferred cations include sodium and ammonium cations, wherein x is an integer of at least 7, preferably at least 9, y is an integer of at least 8, preferably at least 9; $C_{10}$-$C_{18}$ alkyl carboxylates; mid-chain branched alkyl sulphates as described in more detail in U.S. Pat. Nos. 6,020,303 and 6,060,443; methyl ester sulphonate (MES); alpha-olefin sulphonate (AOS); and mixtures thereof.

Another preferred anionic detersive surfactant is an alkoxylated anionic detersive surfactant. The presence of an alkoxylated anionic detersive surfactant in the spray-dried powder provides good greasy soil cleaning performance, gives a good sudsing profile, and improves the hardness tolerance of the anionic detersive surfactant system. It may be preferred for the anionic detersive surfactant to comprise from 1% to 50%, or from 5%, or from 10%, or from 15%, or from 20%, and to 45%, or to 40%, or to 35%, or to 30%, by weight of the anionic detersive surfactant system, of an alkoxylated anionic detersive surfactant.

Preferably, the alkoxylated anionic detersive surfactant is a linear or branched, substituted or unsubstituted $C_{12-18}$ alkyl alkoxylated sulphate having an average degree of alkoxylation of from 1 to 30, preferably from 1 to 10. Preferably, the alkoxylated anionic detersive surfactant is a linear or branched, substituted or unsubstituted $C_{12-18}$ alkyl ethoxylated sulphate having an average degree of ethoxylation of from 1 to 10. Most preferably, the alkoxylated anionic detersive surfactant is a linear unsubstituted $C_{12-18}$ alkyl ethoxylated sulphate having an average degree of ethoxylation of from 3 to 7.

The alkoxylated anionic detersive surfactant, when present with an alkyl benzene sulphonate may also increase the activity of the alkyl benzene sulphonate by making the alkyl benzene sulphonate less likely to precipitate out of solution in the presence of free calcium cations. Preferably, the weight ratio of the alkyl benzene sulphonate to the alkoxylated anionic detersive surfactant is in the range of from 1:1 to less than 5:1, or to less than 3:1, or to less than 1.7:1, or even less than 1.5:1. This ratio gives optimal whiteness maintenance performance combined with a good hardness tolerance profile and a good sudsing profile. However, it may be preferred that the weight ratio of the alkyl benzene sulphonate to the alkoxylated anionic detersive surfactant is greater than 5:1, or greater than 6:1, or greater than 7:1, or even greater than 10:1. This ratio gives optimal greasy soil cleaning performance combined with a good hardness tolerance profile, and a good sudsing profile.

Suitable alkoxylated anionic detersive surfactants are: Texapan LEST™ by Cognis; Cosmacol AES™ by Sasol; BES151™ by Stephan; Empicol ESC70/U™; and mixtures thereof.

Preferably, the anionic detersive surfactant comprises from 0% to 10%, preferably to 8%, or to 6%, or to 4%, or to 2%, or even to 1%, by weight of the anionic detersive surfactant, of unsaturated anionic detersive surfactants such as alpha-olefin sulphonate. Preferably the anionic detersive surfactant is essentially free of unsaturated anionic detersive surfactants such as alpha-olefin sulphonate. By "essentially free of" it is typically meant "comprises no deliberately added". Without wishing to be bound by theory, it is believed that these levels of unsaturated anionic detersive surfactants such as alpha-olefin sulphonate ensure that the anionic detersive surfactant is bleach compatible.

Preferably, the anionic detersive surfactant comprises from 0% to 10%, preferably to 8%, or to 6%, or to 4%, or to 2%, or even to 1%, by weight of alkyl sulphate. Preferably the anionic detersive surfactant is essentially free of alkyl sulphate. Without wishing to be bound by theory, it is believed that these levels of alkyl sulphate ensure that the anionic detersive surfactant is hardness tolerant.

Viscosity Increasing Agent

The viscosity increasing agent is preferably an acid anionic detersive surfactant, preferably a $C_8$-$C_{24}$ alkyl benzene sulphonic acid. However, any acid anionic detersive surfactant may be suitable for use.

Alkalinity Source

The alkalinity source preferably comprises one or more of: sodium hydroxide, carbonate salt and/or silicate salt.

Zeolite Builder

The spray-dried powder typically comprises from 0% to 10 wt % zeolite builder, preferably to 9 wt %, or to 8 wt %, or to 7 wt %, or to 6 wt %, or to 5 wt %, or to 4 wt %, or to 3 wt %, or to 2 wt %, or to 1 wt %, or to less than 1% by weight of the spray-dried powder, of zeolite builder. It may even be preferred for the spray-dried powder to be essentially free from zeolite builder. By essentially free from zeolite builder it is typically meant that the spray-dried powder comprises no deliberately added zeolite builder. This is especially preferred if it is desirable for the spray-dried powder to be very highly soluble, to minimise the amount of water-insoluble residues (for example, which may deposit on fabric surfaces), and also when it is highly desirable to have transparent wash liquor. Zeolite builders include zeolite A, zeolite X, zeolite P and zeolite MAP.

Phosphate Builder

The spray-dried powder typically comprises from 0% to 10 wt % phosphate builder, preferably to 9 wt %, or to 8 wt %, or to 7 wt %, or to 6 wt %, or to 5 wt %, or to 4 wt %, or to 3 wt %, or to 2 wt %, or to 1 wt %, or to less than 1% by weight of the spray-dried powder, of phosphate builder. It may even be preferred for the spray-dried powder to be essentially free from phosphate builder. By essentially free from phosphate builder it is typically meant that the spray-dried powder comprises no deliberately added phosphate builder. This is especially preferred if it is desirable for the composition to have a very good environmental profile. Phosphate builders include sodium tripolyphosphate.

Silicate Salt

The spray-dried powder optionally comprises from 0% to 20 wt % silicate salt, preferably from 1 wt %, or from 2 wt %, or from 3 wt %, and preferably to 15 wt %, or to 10 wt %, or even to 5% silicate salt. Silicate salts include amorphous silicates and crystalline layered silicates (e.g. SKS-6). A preferred silicate salt is sodium silicate.

Carbonate Salt

The spray-dried powder typically comprises carbonate salt, typically from 1% to 50%, or from 5% to 25% or from 10% to 20%, by weight of the spray-dried powder, of carbonate salt. A preferred carbonate salt is sodium carbonate and/or sodium bicarbonate. A highly preferred carbonate salt is sodium carbonate. Preferably, the spray-dried powder may comprise from 10% to 40%, by weight of the spray-dried powder, of sodium carbonate. However, it may also be preferred for the spray-dried powder to comprise from 2% to 8%, by weight of the spray-dried powder, of sodium bicarbonate. Sodium bicarbonate at these levels provides good alkalinity whilst minimizing the risk of surfactant gelling which may occur in surfactant-carbonate systems. If the spray-dried powder comprises sodium carbonate and zeolite, then preferably the weight ratio of sodium carbonate to zeolite is at least 15:1.

High levels of carbonate improve the cleaning performance of the composition by increasing the pH of the wash liquor. This increased alkalinity: improves the performance of the bleach, if present; increases the tendency of soils to hydrolyse, which facilitates their removal from the fabric; and also increases the rate, and degree, of ionization of the soils to be cleaned (n.b. ionized soils are more soluble and easier to remove from the fabrics during the washing stage of the laundering process). In addition, high carbonate levels improve the flowability of the spray-dried powder.

Adjunct Detergent Ingredients

Suitable adjunct ingredients include: detersive surfactants such as anionic detersive surfactants, nonionic detersive surfactants, cationic detersive surfactants, zwitterionic detersive surfactants, amphoteric detersive surfactants; preferred nonionic detersive surfactants are $C_{8-18}$ alkyl alkoxylated alcohols having an average degree of alkoxylation of from 1 to 20, preferably from 3 to 10, most preferred are $C_{12-18}$ alkyl ethoxylated alcohols having an average degree of alkoxylation of from 3 to 10; preferred cationic detersive surfactants are mono-$C_{6-18}$ alkyl mono-hydroxyethyl di-methyl quaternary ammonium chlorides, more preferred are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride; source of peroxygen such as percarbonate salts and/or perborate salts, preferred is sodium percarbonate, the source of peroxygen is preferably at least partially coated, preferably completely coated, by a coating ingredient such as a carbonate salt, a sulphate salt, a silicate salt, borosilicate, or mixtures, including mixed salts, thereof; bleach activator such as tetraacetyl ethylene diamine, oxybenzene sulphonate bleach activators such as nonanoyl oxybenzene sulphonate, caprolactam bleach activators, imide bleach activators such as N-nonanoyl-N-methyl acetamide, preformed peracids such as N,N-pthaloylamino peroxycaproic acid, nonylamido peroxyadipic acid or dibenzoyl peroxide; enzymes such as amylases, carbohydrases, cellulases, laccases, lipases, oxidases, peroxidases, proteases, pectate lyases and mannanases; suds suppressing systems such as silicone based suds suppressors; fluorescent whitening agents; photobleach; filler salts such as sulphate salts, preferably sodium sulphate; fabric-softening agents such as clay, silicone and/or quaternary ammonium compounds; flocculants such as polyethylene oxide; dye transfer inhibitors such as polyvinylpyrrolidone, poly 4-vinylpyridine N-oxide and/or co-polymer of vinylpyrrolidone and vinylimidazole; fabric integrity components such as hydrophobically modified cellulose and oligomers produced by the condensation of imidazole and epichlorhydrin; soil dispersants and soil anti-redeposition aids such as alkoxylated polyamines and ethoxylated ethyleneimine polymers; anti-redeposition components such as carboxymethyl cellulose and polyesters; perfumes; sulphamic acid or salts thereof; citric acid or salts thereof; and dyes such as orange dye, blue dye, green dye, purple dye, pink dye, or any mixture thereof.

EXAMPLES

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

Example 1

A Spray-dried Laundry Detergent Powder and Process of Making it

Aqueous Alkaline Slurry Composition.

| Component | Aqueous slurry (parts) |
|---|---|
| Sodium Silicate | 8.5 |
| Acrylate/maleate copolymer | 3.2 |
| Hydroxyethane di(methylene phosphonic acid) | 0.6 |
| Sodium carbonate | 8.8 |
| Sodium sulphate | 42.9 |
| Water | 19.7 |
| Miscellaneous, such as magnesium sulphate, and one or more stabilizers | 1.7 |
| Aqueous alkaline slurry parts | 85.4 |

Preparation of a Spray-dried Laundry Detergent Powder.

An alkaline aqueous slurry having the composition as described above is prepared in a slurry making vessel (crutcher). The alkaline aqueous slurry is shear thinning and has a viscosity in the range of from 0.5 to 30 Pas at a temperature of 70° C. and at a shear rate of 50 $s^{-1}$. The moisture content of the above slurry is 23.1%. Any ingredient added above in liquid form is heated to 70° C., such that the aqueous slurry is never at a temperature below 70° C. Saturated steam at a pressure of $6.0\times10^5$ Pa is injected into the crutcher to raise the temperature to 90° C. The slurry is then pumped into a low pressure line (having a pressure of $5.0\times10^5$ Pa). Separately, 11.4 parts of $C_8$-$C_{24}$ alkyl benzene sulphonic acid (HLAS), and 3.2 parts of a 50 w/w % aqueous sodium hydroxide solution are pumped into the low pressure line. The viscosity of the alkaline slurry increases. The resultant mixture is then pumped by a high pressure pump into a high pressure line (having an exit pressure of $8.0\times10^6$ Pa). The mixture is then sprayed at a rate of 1,640 kg/hour at a pressure of $8.0\times10^6$ Pa and at a temperature of 90° C.+/−2° C. through a spray pressure nozzle into a counter current spray-drying tower with an air inlet temperature of 300° C. The mixture is atomised and the atomised slurry is dried to produce a solid mixture, which is then cooled and sieved to remove oversize material (>1.8 mm) to form a spray-dried powder, which is free-flowing. Fine material (<0.15 mm) is elutriated with the exhaust the exhaust air in the spray-drying tower and collected in a post tower containment system. The spray-dried powder has a moisture content of 2.5 wt %, a bulk density of 510 g/l and a particle size distribution such that greater than 80 wt % of the spray-dried powder has a particle size of from 150 to 710 micrometers. The composition of the spray-dried powder is given below.

Spray-Dried Laundry Detergent Powder Composition

| Component | % w/w Spray Dried Powder |
|---|---|
| Sodium silicate salt | 10.0 |
| $C_8$-$C_{24}$ alkyl benzene sulphonate | 15.1 |
| Acrylate/maleate copolymer | 4.0 |
| Hydroxyethane di(methylene phosphonic acid) | 0.7 |
| Sodium carbonate | 11.9 |
| Sodium sulphate | 53.7 |
| Water | 2.5 |
| Miscellaneous, such as magnesium sulphate, and one or more stabilizers | 2.1 |
| Total Parts | 100.00 |

A Granular Laundry Detergent Composition.

| Component | % w/w granular laundry detergent composition |
|---|---|
| Spray-dried powder of example 1 (described above) | 59.38 |
| 91.6 wt % active linear alkyl benzene sulphonate flake supplied by Stepan under the tradename Nacconol 90G ® | 0.22 |
| Citric acid | 5.00 |
| Sodium percarbonate (having from 12% to 15% active AvOx) | 14.70 |
| Photobleach particle | 0.01 |
| Lipase (11.00 mg active/g) | 0.70 |
| Amylase (21.55 mg active/g) | 0.33 |
| Protease (56.00 mg active/g) | 0.43 |
| Tetraacetyl ethylene diamine agglomerate (92 wt % active) | 4.35 |
| Suds suppressor agglomerate (11.5 wt % active) | 0.87 |
| Acrylate/maleate copolymer particle (95.7 wt % active) | 0.29 |
| Green/Blue carbonate speckle | 0.50 |
| Sodium Sulphate | 9.59 |
| Solid perfume particle | 0.63 |
| Ethoxylated $C_{12}$-$C_{18}$ alcohol having an average degree of ethoxylation of 7 (AE7) | 3.00 |
| Total Parts | 100.00 |

The above laundry detergent composition was prepared by dry-mixing all of the above particles (all except the AE7) in a standard batch mixer. The AE7 in liquid form is sprayed on the particles in the standard batch mixer. Alternatively, the AE7 in liquid form is sprayed onto the spray-dried powder of example 1. The resultant powder is then mixed with all of the other particles in a standard batch mixer.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for preparing a spray dried powder comprising (i) anionic detersive surfactant;

(ii) from 0 wt % to 10 wt % zeolite builder;

(iii) from 0 wt % to 10 wt % phosphate builder; and (iv) optionally from 0 wt % to 15 wt % silicate salt;

wherein the process comprises the steps of:

(a) forming an alkaline slurry in a mixer, the slurry comprising at least 5 wt % carbonate salt; from 0 wt % to 15 wt % water; and being essentially free of anionic surfactant, the slurry having a viscosity of from 10 to 60 Pas at a temperature of 70° C. and at a shear rate of $50s^{-1}$, wherein the alkaline slurry is shear thinning; and (b) transferring the alkaline slurry from the mixer through a slurry disintegration mixer and through at least one pump to a spray pressure nozzle;

(c) contacting a viscosity increasing agent to the alkaline slurry after the mixer and before the spray pressure nozzle so as to increase the viscosity of the alkaline slurry to form a viscous alkaline slurry whose viscosity is at least two times higher than the viscosity of the alkaline slurry of step (a), step (c) being carried out at an average shear rate of from $10s^{-1}$ to $150s^{-1}$;

(d) spraying the viscous alkaline slurry through the spray pressure nozzle into a spray-drying tower;

(e) spray-drying the viscous alkaline slurry in form a spray-dried powder; and (f) optionally, contacting an alkalinity source with the alkaline slurry and/or the viscosity increasing agent, and/or the viscous alkaline slurry; and (g) spraying a nonionic detersive surfactant onto said spray dried powder.

2. A process according to claim 1, wherein the alkaline slurry comprises from 0 wt % to 10 wt % water.

3. A process according to claim 1, wherein the viscosity increasing agent is an acid anionic detersive surfactant.

4. A process according to claim 1, wherein an alkalinity source is added to the alkaline slurry substantially simultaneously with the viscosity increasing agent.

5. A process according to claim 1, wherein the viscosity increasing agent is a $C_8$-$C_{24}$ alkyl benzene sulphonic acid.

6. A process according to claim 1, wherein the alkalinity source comprises sodium hydroxide.

7. A process according to claim 1, wherein the alkalinity source cumprises carbonate salt.

8. A process according to claim 1, wherein the alkalinity source comprises silicate salt.

9. A process according to claim 1, wherein the nonionic surfactant is an ethoxylated $C_{12}$-$C_{18}$ alcohol having an average degree of ethoxylation of 7.

10. A process according to claim 1 wherein the viscosity increase of step (c) is at least four times that of the alkaline slurry of step (a).

* * * * *